US005940046A

United States Patent [19]

Saleem

[11] Patent Number: 5,940,046

[45] Date of Patent: Aug. 17, 1999

[54] STANDARDIZED MODULAR ANTENNA SYSTEM

[75] Inventor: David J. Saleem, West Kingston, R.I.

[73] Assignee: The United States of America as represented by the Secretary of the Navy, Washington, D.C.

[21] Appl. No.: 08/828,229

[22] Filed: Apr. 14, 1997

[51] Int. Cl.[6] ..... H01Q 1/42

[52] U.S. Cl. ..... 343/872; 343/49; 343/703; 343/368; 385/94; 385/52

[58] Field of Search ..... 343/872, 906; 385/52, 88, 89, 90, 91, 92, 93, 94

[56] References Cited

U.S. PATENT DOCUMENTS 4,581,614 4/1986 LaCourse ..... 343/368
4,818,056 4/1989 Enoches et al. ..... 385/88
5,168,279 12/1992 Knight ..... 343/703
5,768,456 6/1998 Knapp et al. ..... 385/49

*Primary Examiner*—Frank G. Font
*Assistant Examiner*—Layla G. Lauchman
*Attorney, Agent, or Firm*—Michael J. McGowan; Robert W. Gauthier; Prithvi C. Lall

[57] ABSTRACT

For use in a submarine, an easily reconfigurable mast antenna system disposed within an RF transparent radome is disclosed where modularly, interchangeably designed antenna of the system are detachably attached to each other via an electronic interface connector and to a carrier backbone. RF, DC and fiber optic cables transmit signals to antennas operating in the range of 5 kHz to 18 GHz.

20 Claims, 2 Drawing Sheets

STANDARDIZED MODULAR ANTENNA SYSTEM

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

The present invention relates to a novel construction for an antenna system used with submarines. More particularly, the invention relates to a multifunction submarine mast antenna system where each individual antenna within the system is quickly and easily replaced by the same or a dissimilar antenna.

(2) Description of the Prior Art

Communications among submarine fleets are becoming increasingly more sophisticated. As new communication requirements have been added, new antenna systems have been developed from scratch to accommodate the hardware associated with emerging technologies. New antenna systems must be integrated with existing equipment on board the submarine and environmentally tested.

Replacing a single antenna element in a mast antenna system is a tedious and time consuming task which requires great skill. Even if installed correctly, a new component in a mast antenna system may interact differently with the rest of the components in the system and adversely affect overall performance. Connector changes, wire movement, human error or any other factor may also affect overall performance of the antenna system. Repairing an improper replacement of parts to restore proper performance is costly in terms of time and money. Thus, some mast antenna systems are cumbersome and undesirable in that they require extensive hardware design for even simple modifications.

In some antenna systems, antenna modules of a fixed type are used, however, one may only replace such modules with the same type of module. For example, a UHF antenna may be replaced only by another UHF antenna. This is not desirable when different antennas are needed, when a change in the configuration of the antenna system is desired, or when more sophisticated antennas replace the need for existing ones.

In yet other antenna systems, once the antenna modules are developed and installed, the inner mast structure must remain fixed until a hardware redesign is performed. Such prior antennas are replete with shortcomings that detract from their usefulness for uses as herein contemplated.

SUMMARY OF THE INVENTION

It is a general purpose and object of the present invention to provide a mast antenna system that allows individual antennas in the system to be easily and economically changed or replaced by the same or dissimilar antennae, such as replacing a UHF antenna with a VHF, SHF or HF antenna.

It is another object of the present invention to provide a mast antenna system that allows advances in antenna technology to be easily incorporated into an existing antenna mast without high development costs.

It is still another object of the present invention to provide a mast antenna system that can be customized to meet operational requirements as needed or that allows individual antennas to be moved around inside the mast as desired.

Another object of the present invention is to provide a mast antenna system that uses fiber optic cables to transmit signals between an antenna and a radio room inside a submarine.

It is another object of the present invention to provide a mast antenna system where each antenna has uniform connectors that allow mating between both similar and dissimilar antenna types.

The objects are accomplished with the invention which is directed to a standardized modular antenna system which generally comprises a protective, RF transparent radome, an antenna support backbone, antennas, an electronic module associated with each antenna which contains equipment necessary to operate the antenna, electronic interface connectors, and a means to attach each antenna to the antenna support backbone. Each antenna has uniform mating connectors allowing connection between antennas. Each antenna also is shaped to allow a predetermined number of cables to pass therethrough.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

The Standardized Modular Antenna System (SMAS) incorporates a Signal Distribution System (SDS). A desired SDS is capable of handling RF signals from 5 kHz to 18 GHz and is easily reconfigurable, expandable and reliable. A combination SDS incorporates point-to-point cabling (PPC) and fiber optics. The combination is capable of feeding conventional, low frequency antennas using PPC while fiber optic cables, through use of electro-optical converters, send signals to the higher frequency antennas operating at more than 200 MHZ. An advantage of PPC is the ability to incorporate any type of antenna or feed system in the mast. Where possible, electronic componentry found in present radio rooms and masts may be used in new designs, such as the SMAS.

Figure 1:
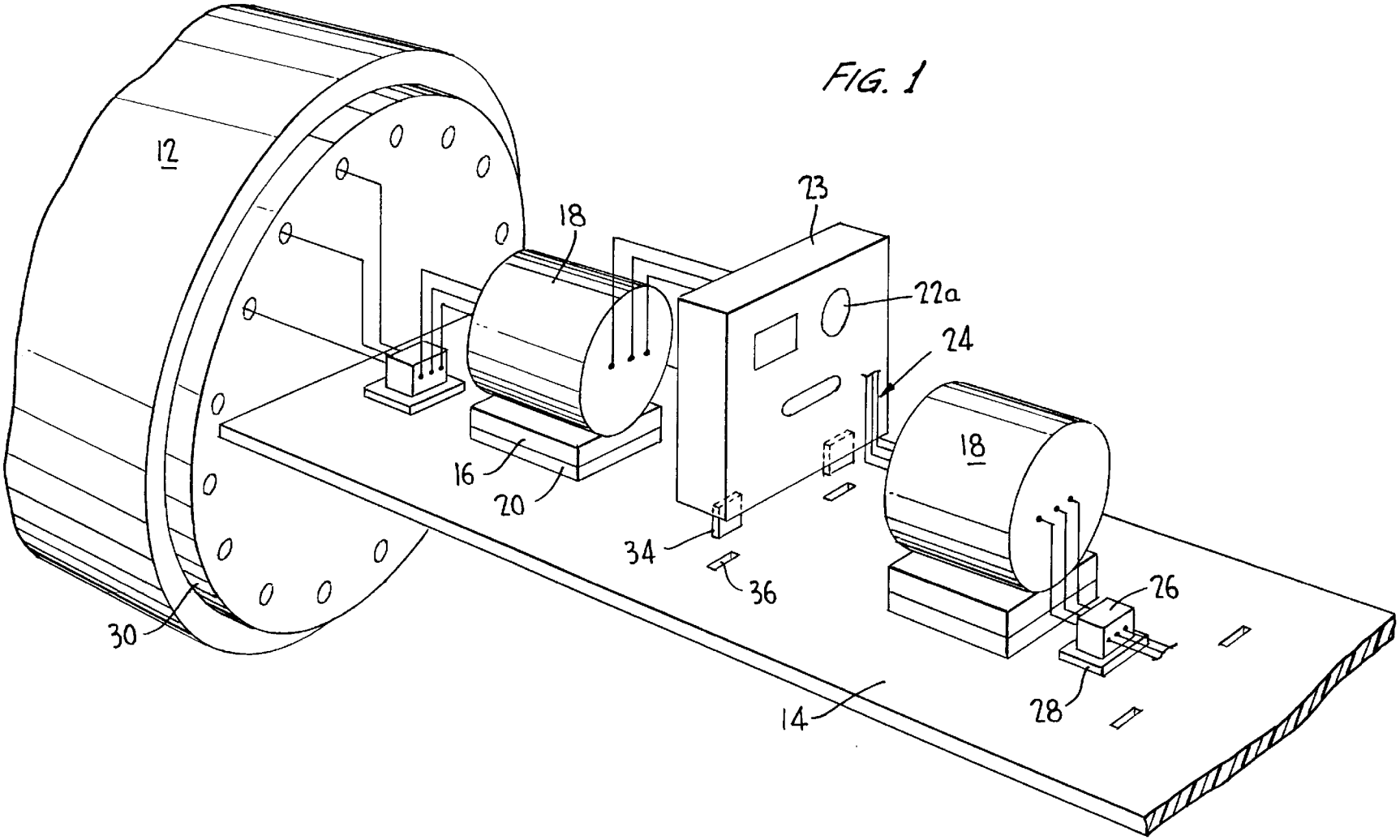
FIG. 1 is a perspective view of the components of the present invention.

Referring to FIG. 1, the Standardized Modular Antenna System (SMAS) utilizes existing radomes to protect sensitive inner electronics. A radome 12 is a protective, RF-transparent "shell" that surrounds antennas in outboard mast antenna systems. A large, one-piece radome, like that of the AN/BRA-34, is generally made from fiberglass (G10 type), chosen for its strength and its transparency to electromagnetic signals. The shape of radome 12 is limited only by the space within the sail compartment for a particular mast and the environmental systems it must withstand.

Generally the following are contained within radome 12 and comprise the antenna system: antennas having a modular design and being sized to a multiple of a given length to facilitate interchangeability; an electronic module associated with each antenna; standard or uniform connectors common to each different antenna; electronic interface connectors; and an antenna support or "backbone" to carry the antennas.

The antenna support is a "backbone" that provides structural support for the antennas. The antenna support backbone 14 may be made of fiberglass. An electronic module 16 is associated with each antenna 18 and comprises the essential electronics needed for that particular antenna such as preamplifiers, amplifiers, relays, mixers and electro-optic devices. Each antenna 18 mates with an electronic module 16 to form a single antenna module. The antennas 18 and electronic modules 16 are fastened to the antenna support backbone 14 by any suitable fastening means 20 allowing easy disconnection and reconnection, such as by snap-on connector or screw attachment. The fastening means 20 for securing the modules to the antenna support backbone 14 are preferably non-metallic and are standard, thereby allowing any particular module to be placed at any location along the antenna support backbone 14.

In one embodiment, the fastening means 20 are installed at regular intervals along the antenna support backbone 14, such as at intervals of 6 inches. In this fashion, each antenna module mates with the antenna support backbone 14 in a manner analogous to that described herein for the plug-in prongs 34 and the prong inputs 36. One antenna module may utilize more than one fastening means 20 depending on the length of the antenna module and the spacing interval between fastening means 20. The spacing interval preferably allows fastening of the most antenna modules possible. Thus, the preferred antenna module has a length that is an integer of the spacing interval.

Figure 2:
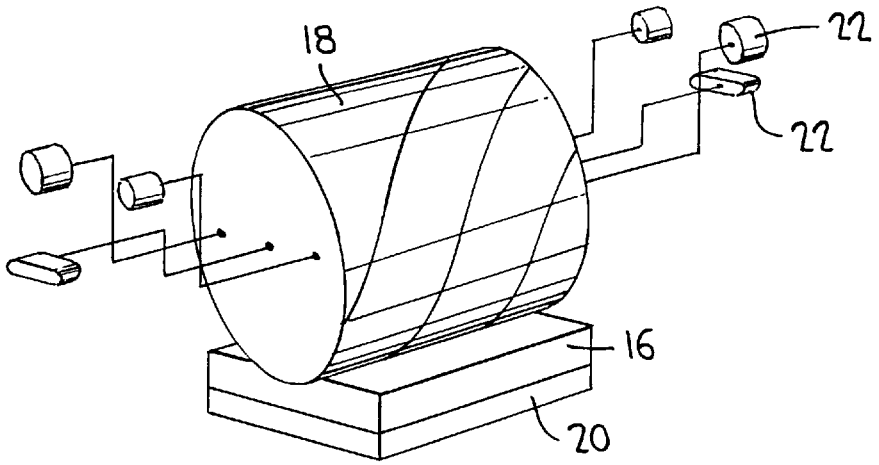
FIG. 2 is an antenna module of the present invention.

Each antenna 18 suitable for use in the assembly is designed to pass a fixed number of cables therethrough. As in FIG. 1 and FIG. 2, each antenna module contains the same number and type of through cables with standard connectors 22 thereby facilitating connection of each type of module with an electronic interface connector 23 which has connector inputs 22*a*. Each electronic interface connector 23 provides a means to connect connectors 22 from adjacent antenna modules, particularly if connectors 22 from adjacent antenna modules are both male. Each electronic interface connector 23 is a component of the SDS, thereby coupling or carrying the signal or DC power carried by the PPC.

Figure 3:
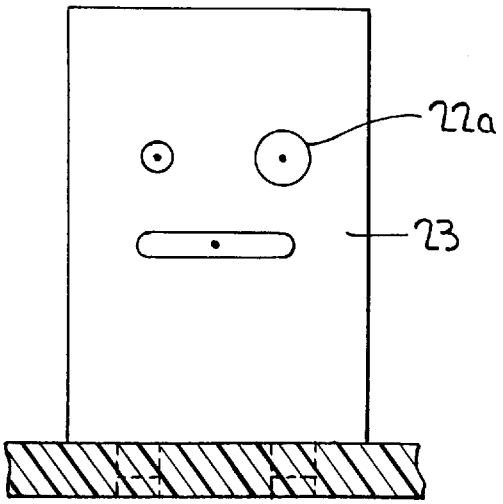
FIG. 3 is a front view of an electronic interface connector of the present invention.
Figure 4:
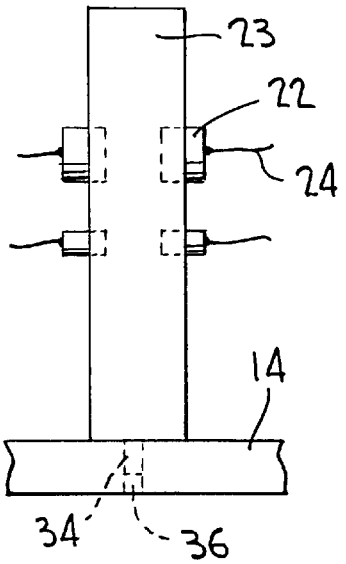
FIG. 4 is a side view of an electronic interface connector of the present invention.

As in FIG. 3 and FIG. 4, each electronic interface connector 23 has plug-in prongs 34 that may be inserted into prong inputs 36 in the antenna support backbone 14. Prong inputs 36 may be spaced along the antenna support backbone 14 approximately every 10 centimeters, which allows any module to be placed, or replaced, anywhere on the antenna support backbone 14 where there is sufficient space.

Alternatively, electronic interface connector 23 may be secured to antenna support backbone 14 using fastening means 20. Preferably, the electronic interface connector 23 and the electronic modules 16 are fastened to antenna support backbone 14 using identical means such as plug-in prongs 36 or fastening means 20, thereby simplifying overall design by standardizing all connections with the antenna support backbone 14.

Connectors 22 connect each adjacent antenna 18 via an electronic interface connector 23. Preferred RF connectors 22 are "easy on/easy off" and must have high reliability. Suitable RF connectors include SMA and Type-N design, and suitable fiber optic connectors include the polarization-preserving ST design. It is preferred that fiber optic cable is not carried through each antenna so as to minimize insertion losses. For example, a system of five antenna modules requires one electronic interface connector 23 between each module, for a total of four electronic interface connectors 23. If each electronic interface connector 23 had an insertion loss of 1 dB, there would be a 10 dB total insertion loss. Thus, the preferred placement of fiber optic cables is through a channel or slot in the antenna support backbone 14.

A fiber optic cable runs from the base of the mast to each of the antenna modules that require a fiber optic connection. Insertion losses are limited to a maximum of 1 dB per polarization-preserving ST connector. Preferred connection for the fiber optic cable must preserve the polarization of the light wave to keep insertion losses to a minimum.

Fiber optic cables are particularly useful in transmitting RF signals between the radio room inside the submarine and an antenna. Use of fiber optic cables allows random placement of antenna modules inside the mast as well as extending the usable frequency range to at least 18 Ghz (SHF). As technology advances to create higher frequency electro-optic converters, new antennas (i.e. greater than 40 GHz) may be used by simply utilizing newly developed electro-optic converters in the antenna modules.

Two RF paths are provided through each antenna 18 and electronic module 16. RF cables are secured between each module using N-type connectors. The two RF cables allow any antenna to be placed anywhere within the mast and have direct access to an RF path to the radio room. More RF lines are desirable, but the number is limited by the size of the hull penetration. High power RF cable, such as RG-217 type cable, passing through each module should handle up to 1000 watts of power while a "medium" power cable, such as RG-142, may carry up to 400 watts.

Cables 24 in the radome 12, including RF and DC types, are passed through the approximate center of each antenna 18 and electronic module 16. Such placement simplifies replacement and maintenance of the modules.

Three "high" current/voltage DC wires are used to provide enough DC power to the high power RF amplifiers 26 in the mast. Each antenna 18 and electronic module 16 is assigned its own DC power line as needed. As an example, in installing an SHF power amplifier, approximately 10 amps of current is needed. Seven "medium" power DC lines are provided with the connectors being specified at approximately 7.0 amps. A ground path to seawater is provided through each connector. This supplies a return path for the DC power for each module.

The SDS design requires that RF power amplifiers 26 be placed inside the mast. The number and type of amplifiers 26 is determined by the communication link and the required antennas. HF and VHF power amplifiers 26 can be located inboard because of the DC power requirements, low transmission line losses, size and Electro-Magnetic Interference (EMI) considerations. Higher frequency RF amplifiers (i.e. >200 MHZ) are located within the mast to reduce the transmission line loss. As an example, a UHF amplifier may be located within the mast, such as a 100 watt amplifier operating across the 225–400 MHZ frequency band with 35-dB of gain. The DC requirements may include 28 volts and up to 10 amps of current.

Amplifiers 26 within the mast radome generate heat that must be dissipated. The amplifiers 26 may be placed on cooling plates 28 located at fixed areas within the SMAS. Where there are cooling plates there are no modules. A desirable cooling system has a dissipation capacity of 600 watts of power. The preferred UHF amplifier will fit within the area having the cooling plates.

As for a JTIDS/IFF/Cellular Phone Power Amplifier, the requirements are driven by IFF. The specification for IFF is 1000 watts peak power transmitted with a 5% duty cycle at the transmitter. Allowing for transmission line loss from a transmitter in a radio room to the antenna in the mast, the actual power received at the antenna is approximately 100 watts peak.

If used, an SHF power amplifier should have at least 600 watts output and should be mounted on a cooling plate.

In passing optical signals to and from the submarine via fiber optic cables, a connector is needed that can join at least 14 single-mode fiber optic cables while preserving the polarization within the fiber optic cables.

The SMAS mast, based on anticipated Navy communications requirements, requires 14 fiber optic channels, three 10-amp DC lines, seven 5-amp DC lines and two RF coaxial lines to enter the radome from outside the sail while preserving the polarization of the optical signals. These lines pass through a baseplate connector and must be accommodated by a hull penetrator insert (HPI).

The baseplate 30 is connected to the antenna support backbone 14. Antenna modules are replaced by separating the baseplate 30 from the radome 12 and pulling the antenna support backbone 14 and attached modules from the radome, thereby allowing easy access to the modules. Once the antenna modules have been reconfigured as desired, the antenna support backbone 14 is reinserted into the radome.

It is expected that problems with Electro-Magnetic Interference (EMI) occur when a single communications mast is expected to operate over a wide number of frequency bands simultaneously. EMI may originate from one or more transmitting antennas while attempting to receive on another communication link on another frequency. The use of fiber optics alleviates some problems, however shielding of electric components remains the best way to reduce EMI.

In operation, a controller in the submarine controls the antennas used in the SMAS mast. The controller switches in or out the desired antenna using relays built into each electronic module located between each antenna module. If a new antenna is added to the SMAS, a new PC card only need be placed in the onboard controller. The invention described herein creates the ability to add communication capability to a submarine without having to redesign an entire system. In order to add communication capability to the SMAS, one need only develop the antenna module and controller card and "plug" each into its respective location.

In light of the above, it is therefore understood that within the scope of the following claims, the invention may be practiced otherwise than as specifically described.

What is claimed is:

1. A standardized modular antenna system for use with a submarine, the system comprising:

a protective, RF transparent radome;

an antenna support backbone;

at least one electronic interface connector;

a plurality of antennas, wherein each antenna has uniform mating connectors to facilitate connection to an electronic interface connector thereby connecting antennas and wherein each antenna is shaped to facilitate passage of a predetermined number of cables therethrough;

an electronic module associated with each antenna, the electronic module comprising componentry for operation of the antenna; and an attaching means for attaching each antenna to the antenna support backbone;

wherein the plurality of antennas may be conveniently reconfigured by attaching an antenna to the antenna support backbone and removing an antenna from the antenna support backbone via the attaching means and connectivity between antennas is maintained by the uniform mating connectors and electronic interface connectors.

2. The invention of claim 1, wherein the plurality of antennas comprises at least one high frequency antenna operating at greater than 200 MHZ and wherein signals transmitted thereto are via fiber optic cable.

3. The invention of claim 1, wherein the plurality of antennas operate in the range of 5 kHz to 18 GHz.

4. The invention of claim 1 further comprising the combination of point-to-point cabling and fiber optic cabling facilitating signal transmission to and from the plurality of antennas.

5. The invention of claim 1, wherein the componentry of the electronic module is selected from the group consisting of electro-optical converters, amplifiers, preamplifiers, mixers, relays, RF connectors, and fiber optics connectors.

6. The invention of claim 1 further comprising fiber optic cable facilitating signal transmission to at least one antenna selected from the plurality of antennas.

7. The invention of claim 6, wherein uniform mating connectors connect fiber optic cables and are of polarization preserving design and limit insertion losses to 1 dB per connector.

8. The invention of claim 1 further comprising a cooling system to dissipate heat generated by the componentry of the electronic module.

9. The invention of claim 8, wherein the cooling system can dissipate up to 600 watts of power.

10. The invention of claim 1 wherein the attaching means for attaching each antenna to the antenna support backbone is a snap-on assembly.

11. A standardized modular antenna system for use with a submarine, the system comprising:

a protective, RF transparent radome;

an antenna support backbone disposed within the radome;

a plurality of antennas, each antenna having a plurality of cables passing therethrough;

an electronic module associated with each antenna, each electronic module comprising componentry for operation of the associated antenna and having a module attaching means for attaching the associated antenna to the antenna support backbone; and an electronic interface connector disposed between each antenna of the plurality of antennas and being adapted to couple to the plurality of cables from each of the antennas adjacent thereto, each electronic interface connector having an interface attaching means for attaching the electronic interface connector to the antenna support backbone.

12. The antenna system of claim 11, wherein the plurality of antennas operate in the range of 5 kHz to 18 GHz and at least one antenna has signals transmitted thereto via fiber optic cable.

13. The antenna system of claim 12, wherein the componentry of the electronic module is selected from the group consisting of electro-optical converters, amplifiers, preamplifiers, mixers, relays, RF connectors, and fiber optics connectors.

14. The antenna system of claim 13, wherein uniform mating connectors connect fiber optic cables and are of polarization preserving design and limit insertion losses to 1 dB per connector.

15. The antenna system of claim 11 further comprising a cooling system to dissipate heat generated by the componentry of the electronic module.

16. The antenna system of claim 11 wherein the antenna support backbone is adapted to receive an module attaching means at regular intervals along the length of the backbone.

17. The antenna system of claim 16 wherein the antenna support backbone is adapted to receive an interface attaching means at regular intervals along the length of the backbone.

18. The antenna system of claim 17 wherein the module attaching means and the interface attaching means are identical.

19. The antenna system of claim 18 wherein each antenna is removeably attached to the antenna support backbone.

20. A method of reconfiguring a mast antenna system comprising the steps:

disengaging an antenna support backbone from the interior of a protective, RF transparent radome, the antenna support backbone having detachably attached thereto a plurality of antennas, wherein each antenna has uniform mating connectors to facilitate connection to an electronic interface connector thereby connecting antennas, wherein each antenna is shaped to facilitate passage of a predetermined number of cables therethrough, and wherein an electronic module is associated with each antenna, the electronic module comprising componentry for operation of the antenna;

selectively adding antennas to the antenna support backbone and removing antennas from the antenna support backbone; and reinserting the antenna support backbone into the interior of the protective, RF transparent radome.

* * * * *